US008523167B2

(12) United States Patent
Ponti

(10) Patent No.: US 8,523,167 B2
(45) Date of Patent: Sep. 3, 2013

(54) DEVICE FOR DIRECTING SHEETS IN ARRIVAL FROM LINES ANGULARLY ARRANGED TOWARDS AN OUTPUT LINE

(75) Inventor: Francesco Ponti, Cerbara-Citta'di Castello (IT)

(73) Assignee: C.M.C. S.r.l., Cerbara-Citta di Castello (IT)

( * ) Notice: Subject to any disclaimer, the term of this patent is extended or adjusted under 35 U.S.C. 154(b) by 0 days.

(21) Appl. No.: 13/381,987

(22) PCT Filed: Jul. 12, 2010

(86) PCT No.: PCT/IB2010/053173

§ 371 (c)(1),
(2), (4) Date: Jan. 3, 2012

(87) PCT Pub. No.: WO2011/007308

PCT Pub. Date: Jan. 20, 2011

(65) Prior Publication Data

US 2012/0112404 A1 May 10, 2012

(30) Foreign Application Priority Data

Jul. 15, 2009 (IT) ..... BO2009A0454

(51) Int. Cl.
*B65H 5/22* (2006.01)

(52) U.S. Cl.
USPC ..... 271/3.14; 271/9.13; 271/225

(58) Field of Classification Search
USPC ..... 271/3.18, 9.13, 225, 184–186, 291, 271/65, 301, 189, 191
See application file for complete search history.

(56) References Cited

U.S. PATENT DOCUMENTS

| | | | |
|---|---|---|---|
| 5,439,208 | A | 8/1995 | Moser et al. |
| 5,649,698 | A | 7/1997 | Auerbach et al. |
| 6,402,136 | B1 | 6/2002 | Lamothe |
| 2004/0080097 | A1 | 4/2004 | Masotta et al. |

FOREIGN PATENT DOCUMENTS

| | | | |
|---|---|---|---|
| EP | 1334937 | A | 8/2003 |
| JP | 1156159 | U | 10/1989 |
| JP | 8188314 | A | 7/1996 |
| WO | WO00/78656 | A | 12/2000 |

OTHER PUBLICATIONS

International Search Report for PCT/IB2010/053173, Mailed Sep. 27, 2010, 4 pages.

*Primary Examiner* — Michael McCullough
(74) *Attorney, Agent, or Firm* — William J. Sapone; Ware Fressola; Maguire & Barber LLP

(57) ABSTRACT

A device is described for directing sheets (2) which has at least two inlets for the sheets, a first inlet (A1) and a second inlet (A2), associated respectively to a first sheet infeeder line (L1) and a second sheet infeeder line (L2), and an outlet (AU) for the sheets. A support member is associated to the first inlet (A1) in order to restingly receive at least one sheet (2) which enters the first inlet (A1)) for transfer of the sheet (2) towards the outlet (AU). A guide and transfer element (D2) is associated to the second inlet (A2) for guiding at least an entering sheet into the second inlet (A2) and to transfer the sheet towards the outlet (AU). The guide and transfer element (D2) and the support member (S) are reciprocally arranged for conveying the sheets (2) towards the outlet along a common outlet direction (DAU).

15 Claims, 6 Drawing Sheets

DEVICE FOR DIRECTING SHEETS IN ARRIVAL FROM LINES ANGULARLY ARRANGED TOWARDS AN OUTPUT LINE

TECHNICAL SECTOR

The invention relates to the technical sector of systems for printing articles in sheet form and subsequent enveloping thereof.

In particular, the present invention relates to a directing device of sheet articles in arrival from two or more angularly-arranged printing lines towards an output line associated for example to a storage station.

PRIOR ART

A typical prior-art printing and enveloping system comprises a plurality of modules, arranged along one or more lines, each having a specific function; the configuration of each line of the system depends on the client's requirements.

A printing and enveloping system is used where large volumes of printed paper materials are required (for example bills, current-account statements, fines, etc.) which have to be sent to the respective destinations, for example in the banking sector, civil service, and/or gas/electric/water bills.

FIG. 1 schematically illustrates a printing and enveloping system of the prior art having two lines, respectively a first line AL1 and a second line AL2.

The first line AL1 comprises, for example, a reel 30, a printing module 40 for printing on the continuous sheet unwinding from the reel 30, cutting organs 50 of the printing continuous sheet, both longitudinal and transversal, in order to realize single sheets 2A, a module 120 for storing the sheets 2A and a module 60 for folding the sheets.

The second line AL2 comprises, for example, an infeeder 80 of single sheets 2A, a printing device 90, a module 100 for storing printed sheets, a module 110 for folding the sheets.

The first line AL1 and the second line AL2 are configured respectively for printing, on the continuous sheet of a reel and on single sheets realized in any way; however, there exist known systems, not illustrated, in which both the lines are configured for printing from reels or on single sheets.

On exiting the first line AL1 and the second line AL2, a transport organ AT is comprised, which includes a plane that develops substantially perpendicular to the development direction of the lines and is destined to receive the sheets from the two lines, and conveyor means for conveying the sheets towards the next station (an enveloping station SI), which conveyor means are constituted by mobile elements FA in channels comprised in the plane; the lines (AL1;AL2) thus release the sheets in different zones of the transport organ AT, respectively distal and proximal with respect to the enveloping station SI.

The two lines (AL1;AL2) must be alternatingly activated, as it is necessary to perform a single insertion of the appropriately-folded sheets internally of each single envelope.

The solution does not enable using both the lines contemporaneously and does not enable sheets from one or the other line to be inserted in a same envelope. In a case where production requirements (for example documents with a large number of pages) make it necessary to insert sheets coming from two different lines to be inserted into the same envelope, the two printing lines have to be configured differently, i.e. they do not exhibit, at output ends thereof, folding modules (60, 110) but rather a single folding module is arranged upstream of the enveloping station SI.

A store is interposed between the folding module and the transport organ AT in order to receive the sheets conveyed by the transport organ and perform a buffer function in relation to the following folding module.

The lines in this specific case therefore release unfolded sheets on the transport organ, which are directed towards the buffer in order to be grouped and subsequently folded in the folding module and enveloped in the enveloping station.

This solution is however characterized by limited productivity, due to the need to activate, in a special phase relation, the release of sheets from the first line onto the transport organ and the release of sheets from the second line onto the transport organ. The second line is activated to release the sheets onto the conveyor organ after passage of the sheets of the first line, which are part of the preceding document, in the release zone H of the conveyor plane.

SUMMARY OF THE INVENTION

The aim of the present invention is to provide a technical solution which enables the user to obviate the above-mentioned drawbacks, by providing a solution which enables the sheets coming from various lines at high production speeds.

A further aim of the invention is to provide a technical solution which enables the above-mentioned drawbacks to be obviated at contained costs with respect to the advantages obtained.

The above aims are all obtained as set out in the independent claims.

BRIEF DESCRIPTION OF THE DRAWINGS

The characteristics of the invention are described herein below, with particular reference to the accompanying tables of the drawings, in which.

DESCRIPTION OF AN EMBODIMENT OF THE INVENTION

With particular reference to FIGS. 2-9, number 1 denotes in its entirety the device for directing sheets of the present invention.

In a preferred embodiment, illustrated in FIGS. 2-5, the device 1 for directing sheets 2 comprises three inlets for the sheets, a first A1, a second A2 and a third A3, associable to respective infeed lines of angularly-arranged sheets, a first L1, a second L2 and a third line L3, and an outlet AU for the sheets, associable to an outlet line LU, the device further comprising:

a support member S associated to the first inlet A1 in order to restingly receive at least a sheet 2 in arrival from the first inlet A1 such as to enable transfer of the sheet 2 towards the outlet AU;

a first element D2, associated to the second inlet A2 and conformed such as to guide at least an entering sheet 2 into the second inlet A2 and to transfer the sheet towards the outlet AU;

a second element D3, associated to the third inlet A3 and conformed such as to guide at least an entering sheet 2 into the third inlet A3 and to transfer the sheet towards the outlet AU.

The first D2 and the second D3 guide and transfer elements and the support member S are arranged with respect to one another such as to transfer the sheets 2 towards the same outlet, in an outlet direction DAU.

Figure 1:
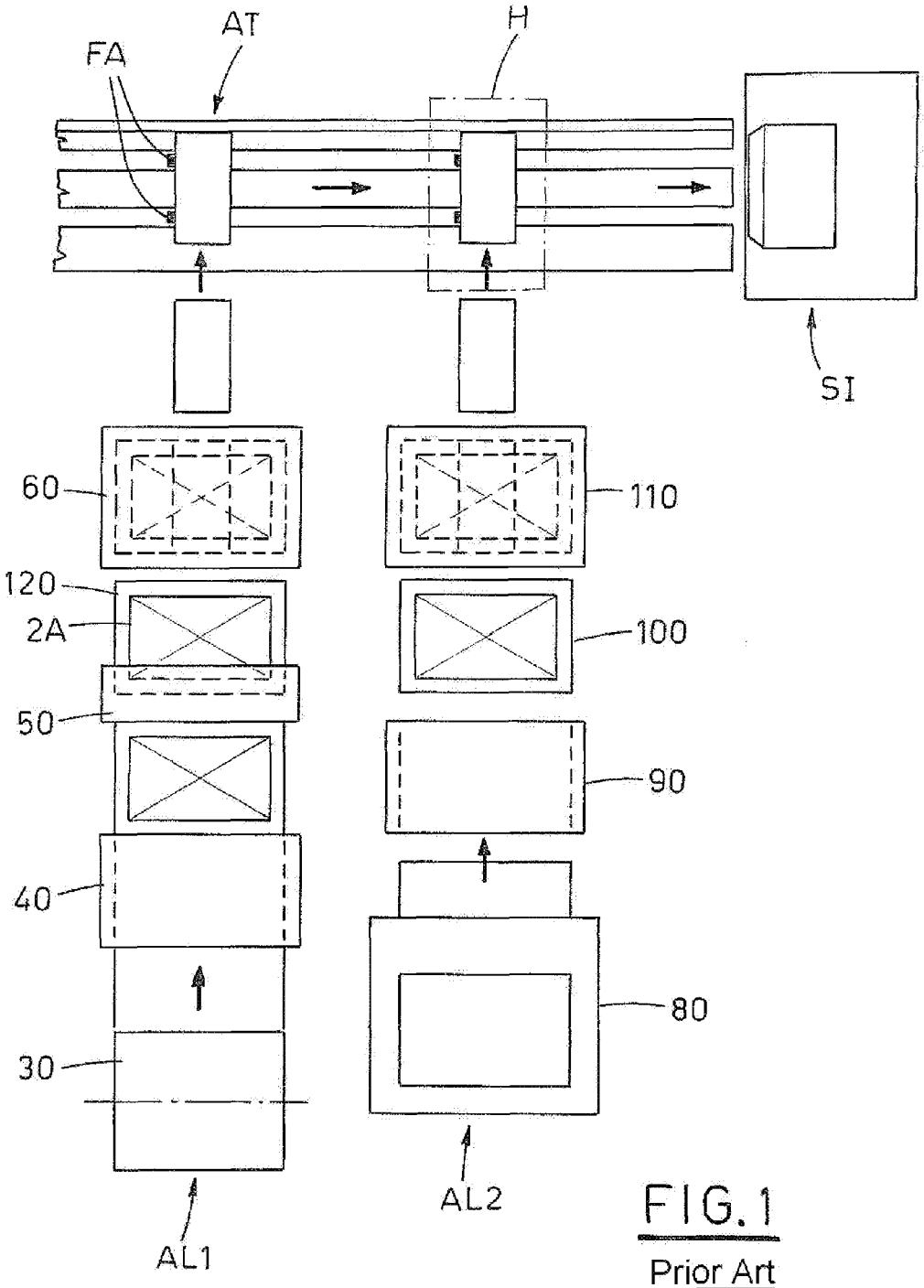
FIG. 1 Prior Art
FIG. 1 is a schematic plan view of a two-line printing and enveloping system of the prior art.
Figure 2:
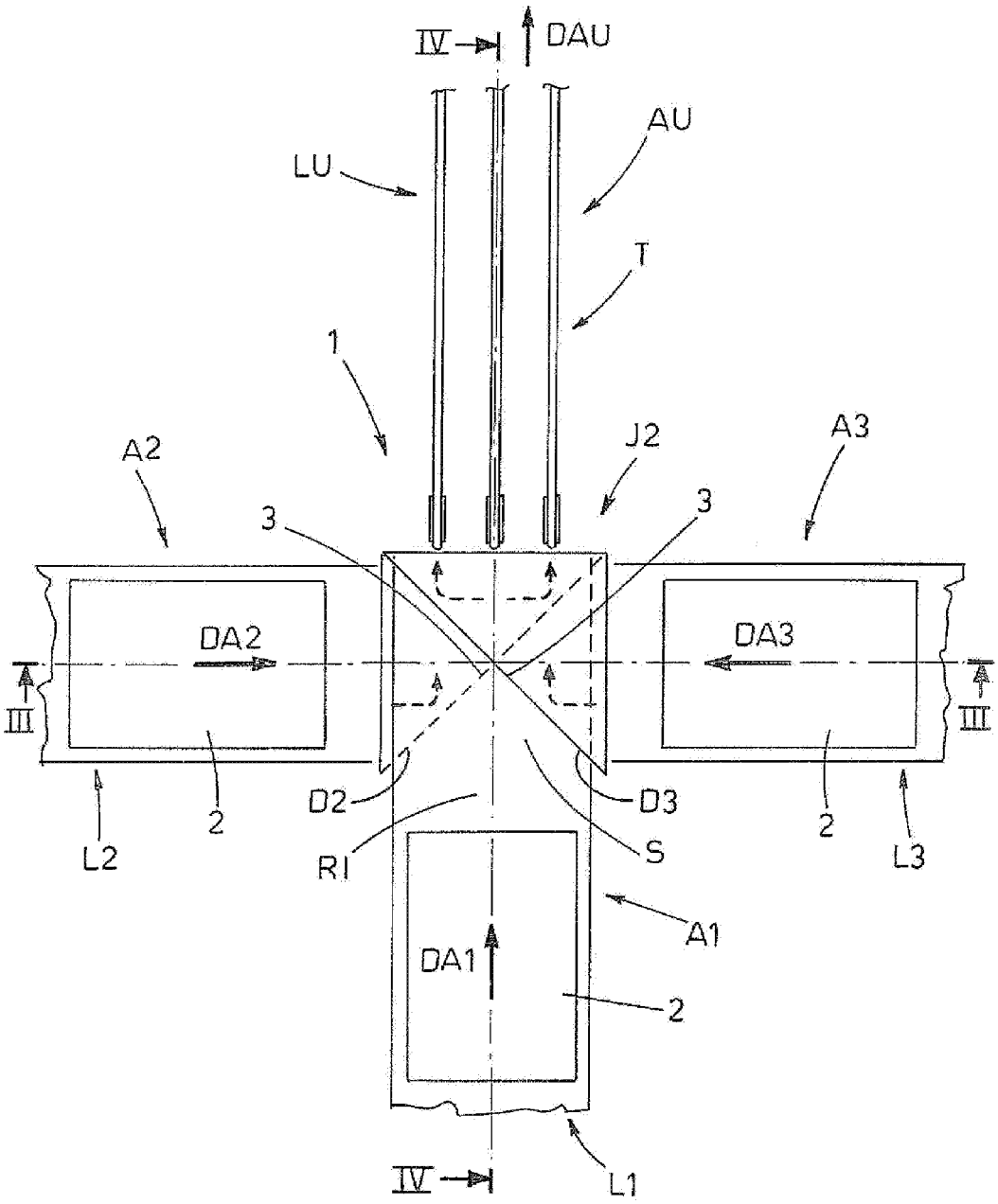
FIG. 2 is a schematic plan view of the device of the present invention according to a preferred embodiment thereof.

The first inlet A1 is substantially aligned to the outlet AU and the second A2 and the third inlets A3 are substantially perpendicular to the first inlet A1, are opposite one another and are arranged on opposite sides of the first inlet A1, as illustrated in FIG. 2.

Figure 3:
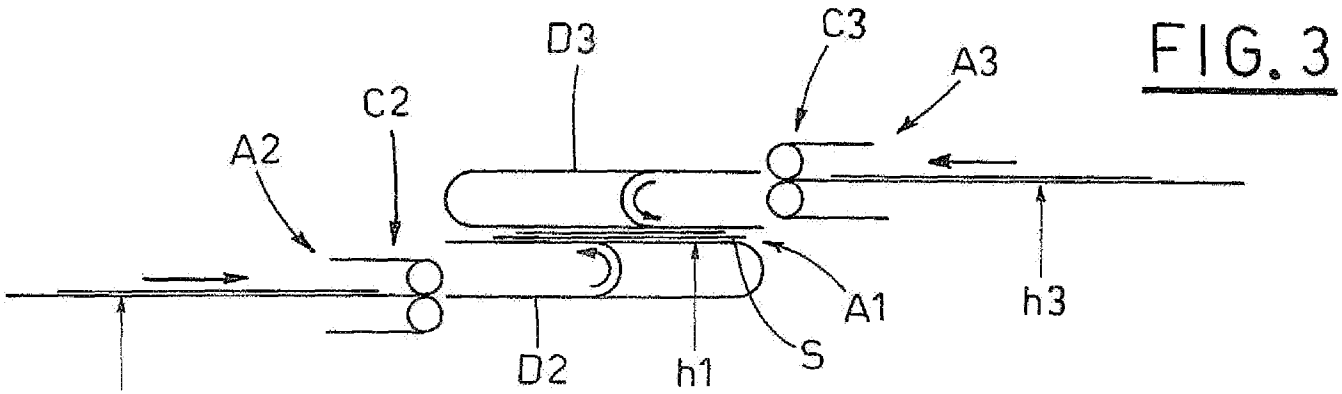
FIG. 3 is a section view, along line III-III of the device of FIG. 2.

The sheets entering the first inlet A1 are therefore not subjected to any deviation, while the sheets entering the second A2 and the third inlet A3 are deviated on a horizontal plane by 90°. As can be seen in FIG. 3, and as will be described in more detail herein below, the sheets entering the second inlet A2 are pushed upwards while the sheets entering the third inlet A3 are pushed downwards.

Figure 4:
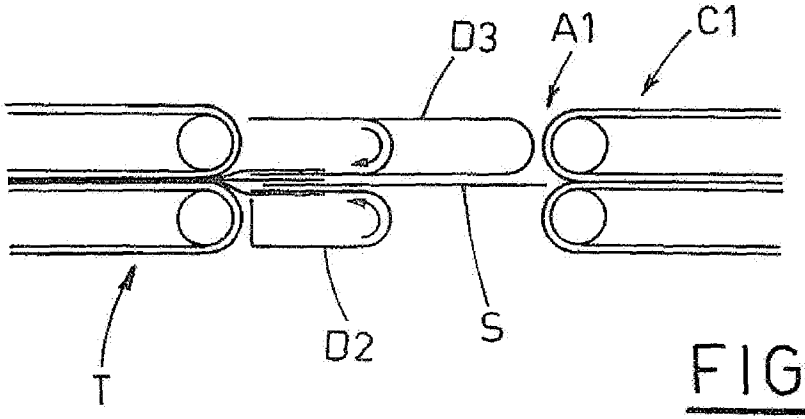
FIG. 4 is a section view, along line IV-IV, of the device of FIG. 2.

The support member S, visible in FIGS. 3 and 4, comprises a plane fixed to a frame and destined to restingly receive the sheets in arrival from the first inlet A1.

Figure 5:
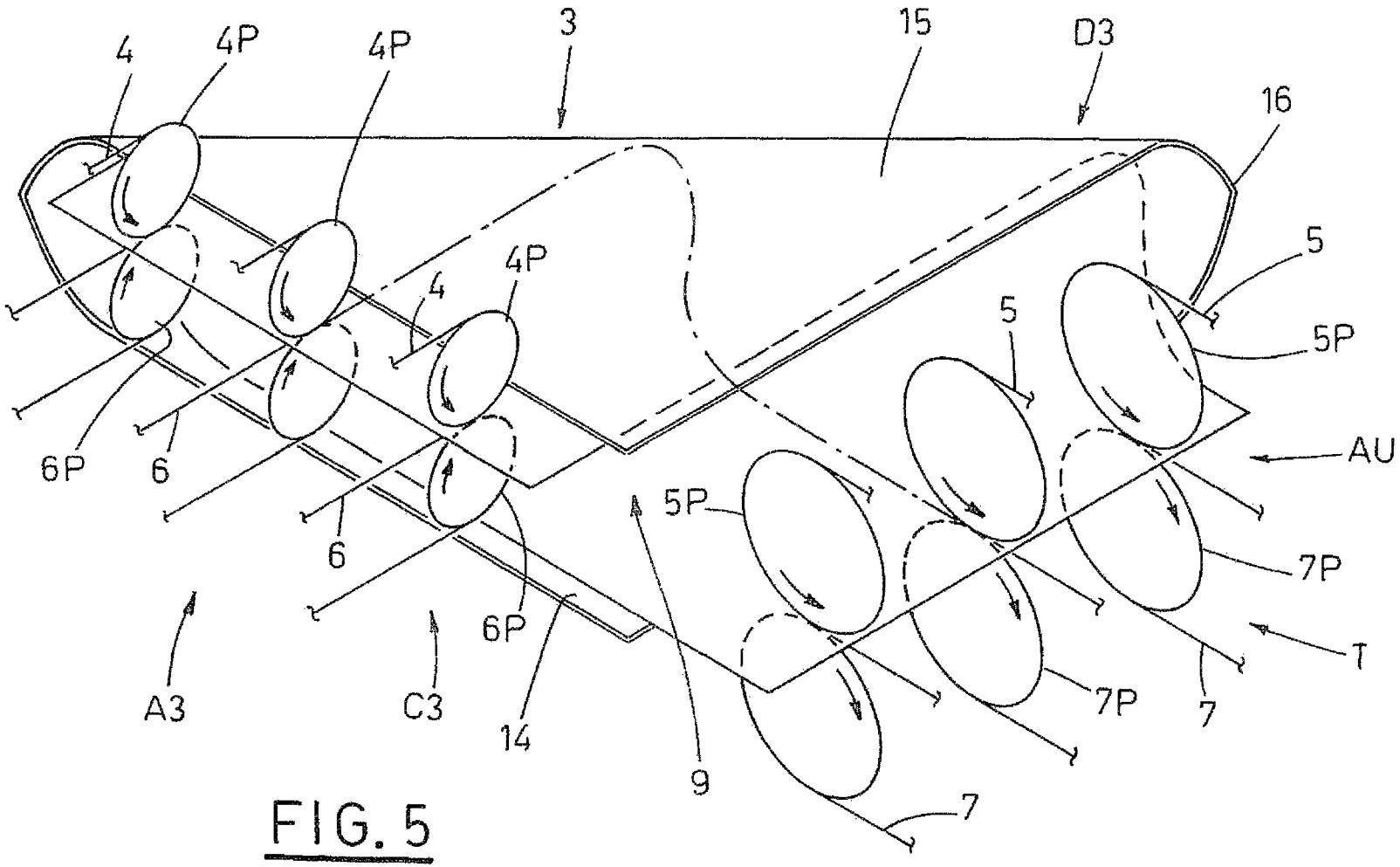
FIG. 5 is a perspective view, along direction J2 of FIG. 2, of a detail of the device of the present invention.

The sheets are conveyed to each inlet A1, A2, A3 by conveyor means C1, C2, C3 which comprise, for example, a first series of upper belts 4, ring-wound about corresponding first pulleys 4P, and a second corresponding series of lower belts 6, ring-wound about corresponding second pulleys 6P (FIG. 5 illustrates the arrangement of the conveyor means for the third inlet A3).

The upper belts and the lower belts 4, 6 are interrupted in the inlet associated thereto, in particular the belts of the first inlet A1 are interrupted in the region RI adjacent to the support member S, i.e. in proximity of the first inlet AI, while the belts of the second A2 and the third inlet A3 are interrupted in proximity of the respective guide and transfer element D2 and D3.

The single sheets or the bundle of superposed sheets 2 are then transported in each line of the infeed lines L1, L2, L3, first, second or third, interposed between the upper belts 4, 5 and the lower belts 6, 7.

Transport means T are located at the outlet AU of the device, comprising a first series of upper belts 5, ring-wound about corresponding first pulleys 5P, and a second corresponding series of lower belts 7, ring-wound about corresponding second pulleys 7P.

The belts 5, 7 are destined to cooperate such as to draw out the sheets coming from the first inlet A1, the second inlet A2 or the third inlet A3, interposed between the belts.

The first and second guide and transfer elements D2 and D3, associated respectively to the second and third conveyor means C2, C3, are constituted by a metal plate 3, so conformed and arranged as to enable a deviation by 90° of a second sheet 2 or a bundle of sheets superposed in inlet.

Each plate 3, visible in FIG. 5, comprises a first lower portion 14, substantially triangular, a second upper portion 15, substantially triangular, and a third portion having a curved profile 16, which connects the lower portion 14 and the upper portion 15; the metal sheet is constrained to a frame, arranged such that the first 14 and the second portion 15 are substantially horizontal and the curved-profile portion 16 is inclined substantially by 45° to the corresponding infeed supply direction DA2, DA3.

The plates 3, constituting the first D2 and the second D3 guide and transfer elements are arranged staggered on the vertical plane; in particular the upper portion 15 of the plate 3 constituting the first transfer element D2 is arranged below the plane of the support member S and the lower portion 14 of the plate 3 constituting the second transfer element D3 is arranged above the support member S, as is visible in FIGS. 3-4.

The first conveyor means C1 transport a sheet at a first height, indicated in FIG. 3 by H1, which is also the transport height of the outlet transport means T, while the second and the third conveyor means C2, C3 transport the sheets respectively at a second height H2, above the transport height H1 of the transport means T, and at a third height H3 higher than the transport height H1 of the transport means T.

FIGS. 3 and 4 illustrate the reciprocal arrangement on a vertical plane of the conveyor means C1, C2, C3 of the infeed lines L1, L2, L3 and the transport means T of the outlet line LU.

The second conveyor means C2 release the sheets conveyed in proximity and superiorly of the lower portion 14 of the plate 3 constituting the first deviating element D2, while the third conveyor means C3 release the sheets conveyed in proximity of and inferiorly of the upper portion 15 of the plate 3 constituting the second deviating element D3.

In the following the functioning of the device of the present invention will be described.

With reference to the third inlet A3, the sheets or the bundle of superposed sheets in arrival from the third line L3 are conveyed by the third conveyor means C3 at a height H3 in a direction of the plate 3 constituting the second deviating means D3.

The sheets 2 are pushed into the region 9 of internal space of the plate 3 of the second deviating means D2 and are progressively released by the belts 4, 6 of the third conveyor means C3 in order to encounter the curved-profile portion 16 of the plate 3; as a consequence of this, the sheets 2 are subjected to a deviation starting from the portion which first contacts the curved-profile portion 16, and are transferred towards the outlet transport means T, being deviated by 90° and also being turned over (i.e. the surface of the sheet facing upwards during the conveying on the third conveyor means C3 is now facing downwards when the sheet, having been deviated, is conveyed on the transport means T).

The transport means T grip the sheet 2 between the respective belts 5, 7 before the sheet 2 is released by the respective belts 4, 6 of the third conveyor means C3; the plate 3 is therefore of such a size as to enable the above gripping sequence.

In the second inlet A2, the transfer operation is similar to the above-described one, with the difference that the sheet 2 is infed according to the inlet direction DA2 above the lower portion 14 of the plate 3 associated to the second inlet A2, respectively at a height H2.

The sheets entering the first inlet A1 do not undergo any deviation; they are released by the belts of the first conveyor means C1 resting on the plane of the support member S such that the sheets are gripped by the belts 5, 7 of the outlet transport means T.

The support member S has a longitudinal extension that is smaller than the length of the sheet, such as to enable the sheet entering the first inlet A1 to be gripped by the transport means T before being released by the first conveyor means C1.

From the outlet AU the sheets are transported by the transport means T towards a following storage station SA downstream of which, for example, a module can be provided for folding the sheets and an enveloping station.

From the above description it is clear how on the outlet line LU the device enables directing sheets destined to be a part of the same document in arrival from the first line L1, the second line L2 and the third line L3, which are infed at the various different device inlets, respectively the first A1, the second A2 and the third A3.

The sheets can be grouped by means of a partial or total superposing in outlet, or can be simply arranged in outlet one after another and thereafter grouped.

The device 1 further comprises means for enabling a user to select the supply of sheets to the infeed lines L1, L2, L3, for example a monitoring unit provided with a device for entering commands, such as a keyboard or alternatively a touch-screen device, functionally connected to a switchboard which enables activating or deactivation of the conveyor means C1, C2, C3 of the inlets.

The selecting means enable, for example, a definition of a combination of activation of the conveyor means C1, C2, C3 in inlet, according to the specific operating requirements of the user, i.e. the means enable activation of any combination of the conveyor means C1, C2, C3 or activation of only the first C1, the second C2 or the third C3 conveyor means.

From the above it emerges that the directing device is very flexible, as the user can decide how many and which printing lines to use according to the characteristics of the document which will be printed and the configuration of each line (colour-printing line, black and white, reel, etc.).

An advantage of the present invention consists therefore in having created a directing device for sheets from angularly arranged lines that is versatile and low-cost.

Figure 6:
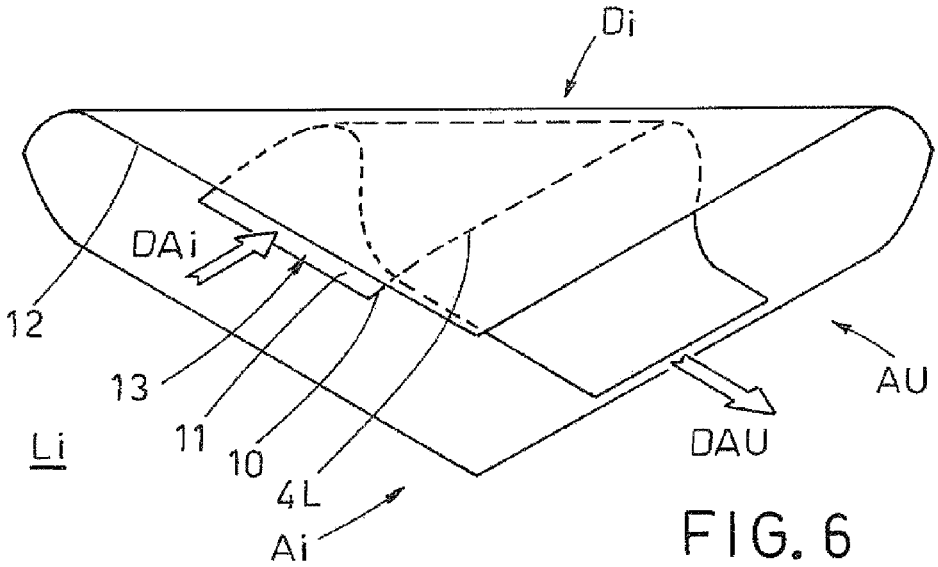
FIG. 6 is a perspective view of a variant of the detail of FIG. 5, in a different scale with respect to FIG. 5.

In a variant, illustrated in FIG. 6, the guide and transfer element of a generic inlet $A_i$ denoted with general reference number $D_i$, further comprises a counter-plate 4L that is positioned facing the plate 3 in the region of space 9 internal of the plate 3.

The facing walls 11, 12 of respectively the counter-plate 4L and the plate 3 identify a region 13, internal of the guide and transfer element $D_i$, into which the sheets 2 are guided and transferred; the deviation of the sheets 2 from the inlet direction $Da_i$; to the perpendicular outlet direction DAU thus occurring internally of the volume defined by the region 13.

The counterplate 4L, in association with the plate 3, advantageously enables the sheets 2 to be guided internally of the deviator means $d_i$; this guiding action advantageously prevents the sheet, at higher operating levels, from creasing up and getting blocked internally of the deviating means, causing the line to be shut down until the blockage is cleared.

The counter-plate 4L further comprises an inlet portion 10, inclined such as to facilitate the entry of the sheets into the above-mentioned region 13.

An advantage of this variant is that it enables an increase in the advancement velocity of the sheets in arrival from an inlet supply line $L_i$ to the device, preventing the sheets from getting blocked internally of the deviating means $D_i$ and obstructing the device (for example in consequence of unexpected folding of the sheet).

Figure 7:
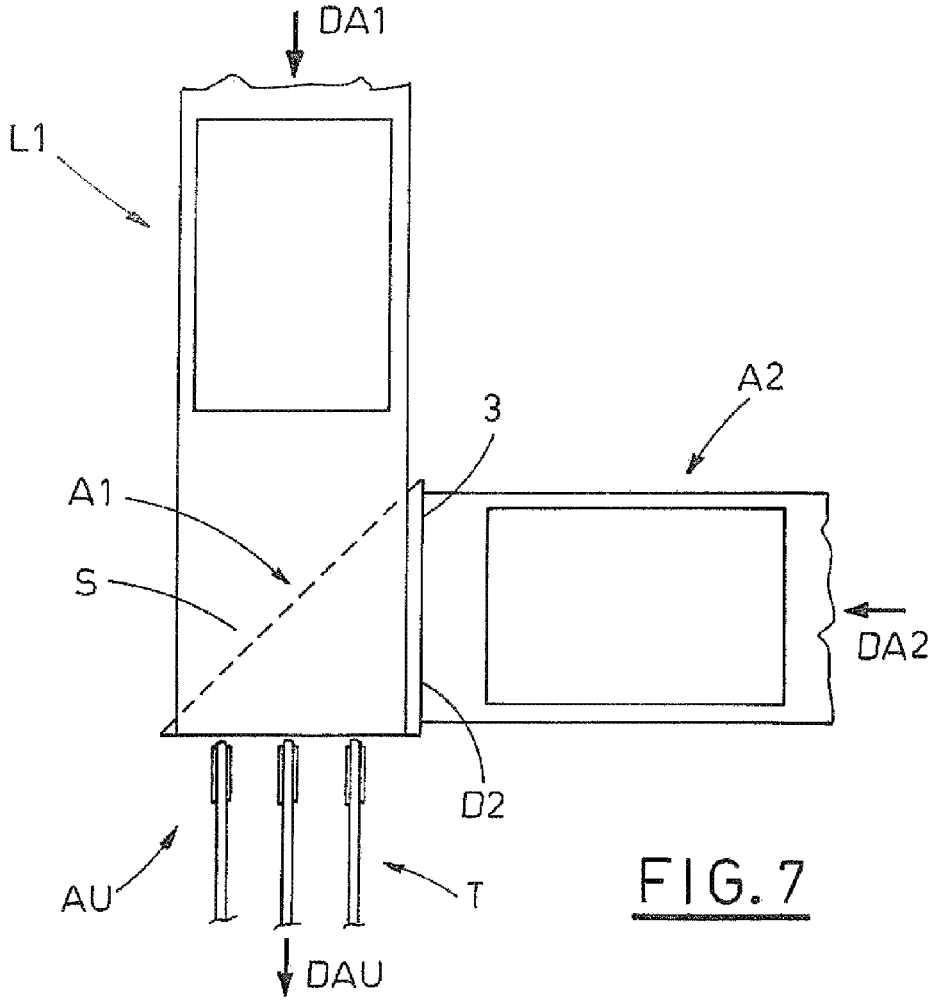
FIG. 7 is a schematic plan view of the device in a further embodiment thereof.

In a further embodiment, illustrated in FIG. 7, the device comprises only two inlets for the sheets, respectively a first A1 and a second A2 inlet, and an outlet AU for the sheets; this embodiment is different from the preferred embodiment of FIGS. 2-5 as it does not include the third inlet A3.

The plate 3 constituting the guide and transfer element associated to the second inlet A2 is arranged below the support member S; alternatively the plate 3 can also be arranged above the support member S.

The above embodiment contains the same technically advantageous characteristics as the preferred embodiment.

In a further embodiment, not illustrated, the device comprises only two inlets for the sheets, respectively a first and a second, and an outlet for the sheets, and further comprises:

a first element, associated to the first inlet and conformed such as to guide at least a sheet which enters the first inlet and to transfer the sheet towards the outlet;

a second element, associated to the second inlet and conformed such as to guide at least a sheet which enters the second inlet and to transfer it towards the outlet.

The guide and transfer elements, described previously with reference to the preferred embodiment of FIGS. 2-5, are arranged with respect to one another in such a way as to transfer the sheets towards the outlet along a same outlet direction; the elements are thus staggered in height.

This embodiment does not therefore include the support member; the two inlets, first and second, have an inlet direction which is such that one is opposite the other and perpendicular to the outlet advancement direction.

The first and the second deviating elements enable the sheets in inlet to be deviated by 90°, guiding and transferring them towards the outlet transport means T, in the way described previously with reference to the preferred embodiment.

Figure 9:
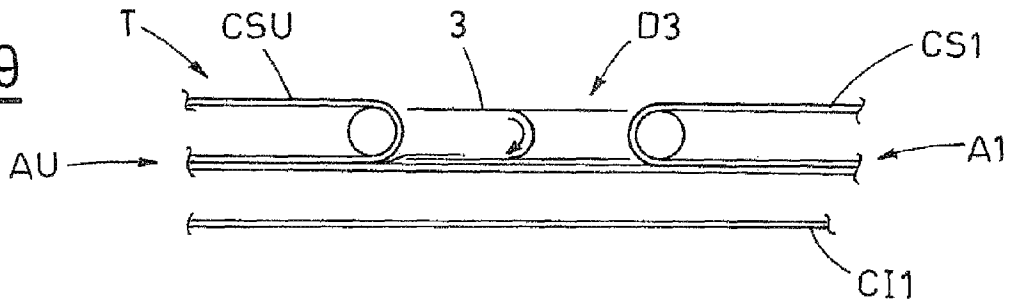
FIG. 9 is a section view along line IX-IX of the device of FIG. 8.
Figure 8:
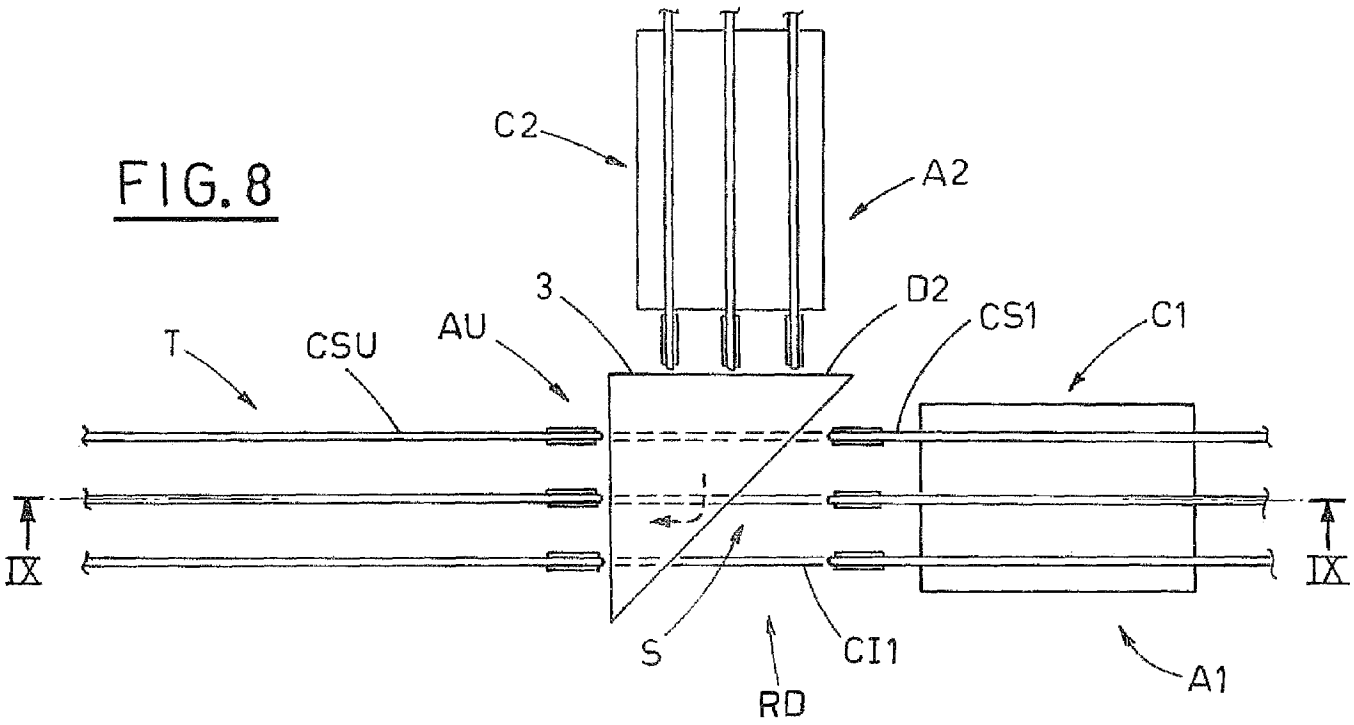
FIG. 8 is a schematic plan view of the device in a further embodiment thereof.

In a still further embodiment, illustrated in FIGS. 8-9, the device comprises two only inlets for the sheets, respectively a first inlet A1 and a second inlet A2, and an outlet AU for the sheets.

The device comprises:

a mobile support member S, associated to the first inlet A1, for restingly supporting at least a sheet 2 which enters the first inlet AI such as to enable transfer of the sheet towards the outlet AU;

an element D2, associated to the second inlet A2 and conformed such as to guide the sheets entering the second inlet A2 and to transfer them towards the outlet AU.

In this embodiment, the first inlet A1 of the device is associated to conveyor means C1 constituted by a pair of belts, first upper belts CS1 and first lower belts CI1, the first lower belts CI1 being uninterrupted between the first inlet A1 and the outlet AU and further constituting, in cooperation with the upper belts CSU at the outlet AU and of the device, the transport means T of the outlet line. The first upper belts CS1 are interrupted at the first inlet A1, and the upper belts CSU of the outlet AU develop starting from the outlet AU; an interruption region is defined, denoted by RD.

The plate 3 constituting the element D2, associated to the second inlet A2 for guiding the sheets entering the second inlet A2 and transferring them towards the outlet AU, is arranged superiorly of the first lower belts CS1, in the region RD between the first lower belts CS1 and the upper outlet belts CSU.

The mobile support member S is constituted by the upper branch of the first lower belts CI1, which supports the sheets entering the first inlet A1 in the region denoted by RD, in order to convey them from the inlet A1 towards the outlet AU.

This embodiment has the same technical-advantageous characteristics as the preferred embodiment.

It is understood that the above has been described by way of non-limiting example, and any eventual constructional variants are understood to fall within the ambit of protection of the present technical solution, as described herein above and as claimed in the following.

The invention claimed is:

1. A device for directing sheets (2) comprising:

at least two inlets for the sheets, a first inlet (A1) and a second inlet (A2), which inlets are associable respectively to a first sheet infeeder line (L1) and a second sheet infeeder line (L2) angularly-arranged with respect to said first sheet infeeder line (L1), and an outlet (AU) for the sheets, associable to an outlet line (LU):

a support member (S) associated to the first inlet (A1) in order to restingly receive at least one sheet (2) arriving from the first inlet (A1) so as to enable transfer of the sheet (2) towards the outlet (AU);

a guide and transfer element (D2), associated to the second inlet (A2) and conformed so as to guide at least an entering sheet into the second inlet (A2) and to transfer the sheet towards the outlet (AU);

the guide and transfer element (D2) and the support member (S) being reciprocally arranged so as to convey the sheets (2) towards the outlet along a common outlet direction (DAU);

a third inlet (A3), associable to a third line (L3) angularly arranged with respect to the first line (L1), and a further guide and transfer element (D3), associated to the third inlet (A3) and conformed to guide at least a sheet entering the third inlet (A3) and to transfer the sheet towards the outlet (AU); and, wherein the inlets (A1, A2, A3) are arranged at different heights.

2. The device of claim 1, wherein the guide and transfer element is arranged so as to enable deviation of a sheet by substantially 90° with respect to an inlet direction (DA2), an inlet direction (DA1) of the sheets in the first inlet (A1) being substantially aligned with the outlet direction (DAU), the first inlet (A1) and the second inlet (A2) being substantially perpendicular to one another.

3. The device of claim 2, wherein the support member (S) is a plane, solidly constrained to the guide and transfer element (D2) for supporting a sheet entering the first inlet (A1).

4. The device of claim 1, wherein the support member (S) is a plane, solidly constrained to the guide and transfer element (D2) for supporting a sheet entering the first inlet (A1).

5. The device of claim 1, wherein the support member (S) is constituted by an upper branch of a strap conveyor means (CI1) and conveys the at least one sheet entering the first inlet (A1) at least from the first inlet (A1) to the outlet (AU), the guide and transfer element (D2) being arranged above the strap conveyor means (CI1).

6. The device of claim 1, wherein the third inlet (A3) is opposite the second inlet (A2).

7. The device of claim 1, wherein the guide and transfer element (D2) of the second inlet (A2) and the further guide and transfer element (D3) of the third inlet (A3) are, on a vertical plane, staggered with respect to the outlet (AU), respectively above and below or vice versa, and the support member (3) is substantially aligned with the outlet (AU).

8. The device of claim 1, wherein the guide and transfer element (D2) of the second inlet (A2) and the further guide and transfer element (D3) of the third inlet (A3) are, on a vertical plane, staggered with respect to the outlet (AU), respectively above and below or vice versa, and the support member (3) is substantially aligned with the outlet (AU).

9. The device of claim 1, wherein the support member (S) is a plane, solidly constrained to the guide and transfer element (D2) for supporting a sheet entering the first inlet (A1).

10. A device for directing sheets (2) comprising:

at least two inlets for the sheets, a first inlet and a second inlet, associable to a respective first sheet supply line and a second sheet supply line, and an outlet for the sheets, associable to an outlet line:

a first guide and transfer element, associated to the first inlet and conformed so as to guide at least a sheet entering the first inlet and transfer the sheet towards the outlet;

a second guide and transfer element, associated to the second inlet and conformed so as to guide at least a sheet entering the second inlet and transfer the sheet towards the outlet;

the first and second guide and transfer elements being reciprocally arranged so as to convey the sheets towards the outlet along a common direction;

a third inlet (A3), associable to a third line (L3) angularly arranged with respect to the first line (L1), and a third guide and transfer element (D3), associated to the third inlet (A3) and conformed to guide at least a sheet entering the third inlet (A3) and to transfer the sheet towards the outlet (AU); and, wherein the inlets (A1, A2, A3) are arranged at different heights.

11. The device of claim 10, wherein the third inlet (A3) is opposite the second inlet (A2).

12. The device of claim 10, wherein each of the first guide and transfer element and the second guide and transfer element (D2, D3) comprises a plate (3), constituted by a lower first portion (14), an upper second portion (15), and a curved-profile portion (16) which connects the first portion and the second portion (15), the curved-profile portion (16) being arranged angularly with respect to an inlet direction (DA2, DA3), in order to deviate the sheets in the inlet towards the outlet (AU).

13. The device of claim 12, further comprising a counter-plate (4L), associated with each plate (3), positioned internally of the plate (3) and conformed so that each sheet crosses a region defined by facing surfaces (11, 12) of the plate (3) and the counter-plate (4L) which guide the sheet towards the outlet (AU).

14. The device according to claim 12, wherein each of the lower first portion and the upper second portion have a triangular shape, and wherein the curved-profile portion (16) is arranged angularly with respect to the inlet direction (DA2, DA3) at an angle of 45°.

15. A device for directing sheets (2) comprising:

at least two inlets for the sheets, a first inlet and a second inlet, associable to a respective first sheet supply line and a second sheet supply line, and an outlet for the sheets, associable to an outlet line:

a first guide and transfer element, associated to the first inlet and conformed so as to guide at least a sheet entering the first inlet and transfer the sheet towards the outlet;

a second guide and transfer element, associated to the second inlet and conformed so as to guide at least a sheet entering the second inlet and transfer the sheet towards the outlet;

the first and second guide and transfer elements being reciprocally arranged so as to convey the sheets towards the outlet along a common direction;

a third inlet (A3), associable to a third line (L3) angularly arranged with respect to the first line (L1), and a third guide and transfer element (D3), associated to the third inlet (A3) and conformed to guide at least a sheet entering the third inlet (A3) and to transfer the sheet towards the outlet (AU);

wherein the third inlet (A3) is opposite the second inlet (A2);

wherein the second guide and transfer element (D2) of the second inlet (A2) and the third guide and transfer element (D3) of the third inlet (A3) are, on a vertical plane, staggered with respect to the outlet (AU), respectively above and below or vice versa.

* * * * *